United States Patent [19]

Queren

[11] 4,390,867

[45] Jun. 28, 1983

[54] BURGLAR ALARM SYSTEM

[76] Inventor: James Queren, 218-07 43rd Ave., Bayside, N.Y. 11361

[21] Appl. No.: 289,373

[22] Filed: Aug. 3, 1981

[51] Int. Cl.[3] ..... G08B 13/06

[52] U.S. Cl. ..... 340/542; 200/61.64; 200/61.68; 292/346; 340/545

[58] Field of Search ..... 340/542, 545, 550; 200/61.64, 61.67, 61.68, 61.93; 292/346

[56] References Cited

U.S. PATENT DOCUMENTS

| | | | |
|---|---|---|---|
| 1,347,506 | 7/1920 | Gordon | 200/61.68 |
| 1,610,224 | 12/1926 | Dalboni et al. | 340/542 X |
| 2,660,632 | 11/1953 | Makishima | 340/542 X |
| 2,842,631 | 7/1958 | Martens | 340/542 X |
| 3,570,285 | 3/1971 | Hawkins | 200/61.64 X |
| 3,978,467 | 8/1976 | Albert | 340/545 X |
| 4,010,968 | 3/1977 | Rehfeld | 340/550 X |
| 4,074,484 | 2/1978 | Queren | 292/346 X |
| 4,178,588 | 12/1979 | Queren | 340/550 X |

*Primary Examiner*—David L. Trafton
*Attorney, Agent, or Firm*—Kurt Kelman

[57] ABSTRACT

A burglar alarm system mounted in a reinforced doorway and comprising a control circuit having a normally open switch point consisting of a flange projecting from the backer plate towards the striker plate of the door lock, the flange being out of contact with, but close to, a long latch bolt projecting into the latch bolt hole for locking the door, and a contact having an electrical polarity opposite to that of the backer plate. The contact extends towards, but is normally slightly spaced from, the flange whereby the switch point is open and the control circuit is not energized. Displacement of the latch bolt towards the flange by a burglar tool and resultant displacement of the flange towards the contact causes the flange to touch the contact and energizes the control circuit to set off the alarm.

7 Claims, 8 Drawing Figures

FIG.7
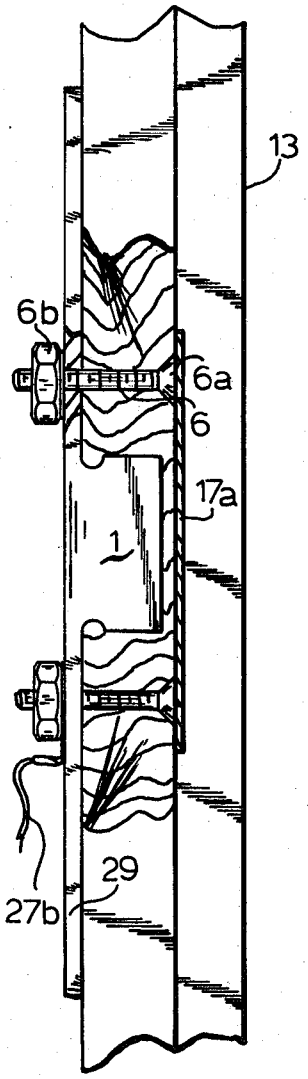
FIG.4
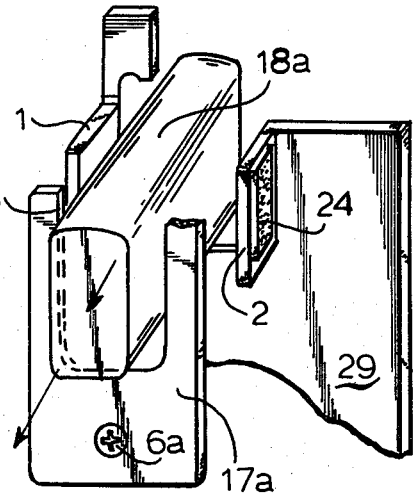
FIG.5
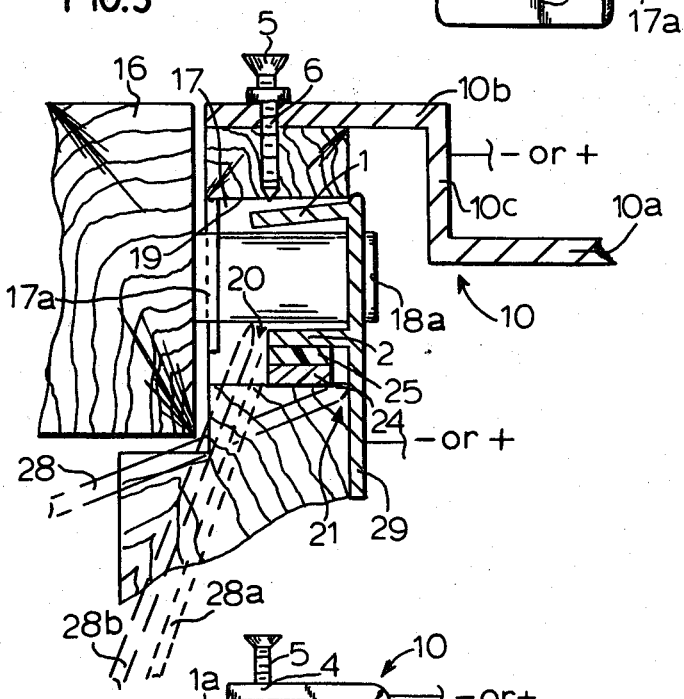
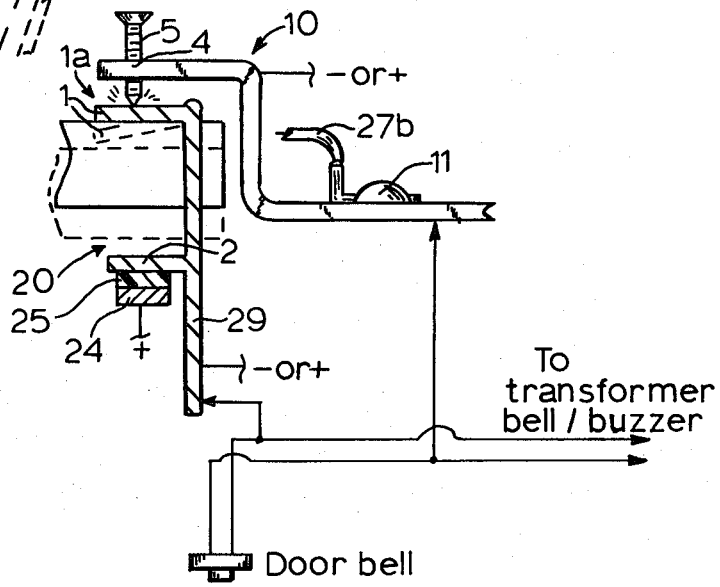
FIG. 6

BURGLAR ALARM SYSTEM

BACKGROUND OF THE INVENTION

The present invention relates to improvements in a burglar alarm system mounted in a reinforced doorway framing for preventing forcible entry into a structure closed by a door, such as fully disclosed and claimed in my U.S. Pat. No. 4,074,484, dated Feb. 21, 1978, whose disclosure is incorporated herein by way of reference.

The doorway framing disclosed in my patent comprises a wooden door jamb having two substantially parallel major faces and two minor faces substantially perpendicular to the major faces, one of the major faces having a recessed end portion delimited by one of the minor faces and a shoulder constituting a stop for a door, and the door jamb defining a door latch bolt hole in the recessed end portion. The door jamb is mounted on a wall including wooden wall stud means adjacent the other major face of the door jamb, the other major face and the wall defining a narrow space therebetween. A reinforcement metal plate extends over a substantial portion of the wall stud means and a substantial portion of the one minor face of the door jamb, the reinforcement plate being securely affixed to the wall stud means and the one minor door jamb face and covering a substantial region of the minor door jamb face adjacent and beyond the door latch bolt hole, the securely affixed plate holding the door jamb firmly in position. A striker plate defines a hole registering with the bolt hole and is mounted thereover on the jamb.

In my copending U.S. patent application Ser. No. 888,412, filed Mar. 20, 1978, I have disclosed an improvement in such a doorway framing, which comprises an electrically conductive rigid backer plate arranged in the narrow space in contact with the other major face of the door jamb and in registry with the striker plate, and fastening elements securing the striker and backer plates to the door jamb, the fastening elements passing through the door jamb between the striker and backer plates whereby the door jamb is sandwiched between the striker and backer plates. The disclosure of this application is also incorporated herein by way of reference.

In my U.S. Pat. No. 4,178,588, dated Dec. 11, 1979, I have disclosed and claimed a burglar alarm system having an electrical control circuit connected to a reinforced doorway framing of the above-described type for setting off a burglar alarm.

SUMMARY OF THE INVENTION

It is the primary object of this invention to provide a more effective and versatile burglar alarm system and a more secure locking of the door in the reinforced doorway framing hereinabove described.

It is a more particular object of the invention to provide such a system which will be set off at the very beginning of the burglary operation before substantial damage has been done to the door jamb or the lock bolt, thus avoiding the necessity of extensive repairs after the burglary attempt.

It is another specific object of the present invention to provide a more secure lock with an elongated latch bolt engaging the latch bolt hole in the door jamb through its entire length, the striker and backer plates being securely affixed to the door jamb and providing a strongly fixed guide for the latch bolt projected into the bolt hole upon locking of the door.

The above and other objects are accomplished according to this invention with a backer plate of a predetermined electrical polarity and defining a hole registering with the hole in the striker plate, whereby a long latch bolt may be projected from the door into the latch bolt hole through the holes in the striker and backer plates. The improved burglar alarm system comprising a burglar alarm and an electrical control circuit connected to the burglar alarm and energizable to set off the alarm has a normally open switch point consisting of a flange projecting from the backer plate towards the striker plate slightly recessed from the hole in the striker plate and slightly inclined towards the striker plate hole whereby the backer plate flange is out of contact with, but close to, the long latch bolt projected into the latch bolt hole for locking the door, and a contact element having an electrical polarity opposite to the electrical polarity of the backer plate. The contact element is mounted in the reinforcement plate and extends towards, but is normally slightly spaced from, the flange whereby the switch point is open and the control circuit is not energized. Displacement of the projected latch bolt towards the flange by a burglar tool and resultant displacement of the flange towards the contact element causes the flange to touch the contact element and energizes the control circuit to set off the alarm.

The alarm will remain effectively de-energized under all normal conditions of use of the door will being quite sensitive even to the opening movements of a burglar tool used in an attempt to jimmy the door open if the backer plate flange is recessed from the striker plate hole an average of about one eighth of an inch while the contact element is normally spaced from the flange about one eighth of an inch, the backer plate flange being inclined at an angle of about 85° to 87°.

An efficient contact element is a screw threadedly received in the reinforcement plate and having a point extending towards the backer plate flange. If this is a brass set screw, the space between the contact element and the flange may be adjusted to any desired sensitivity of the alarm system.

The versality of the system is considerably enhanced according to a preferred feature of the invention with a control circuit which has two additional normally open switch points responsive to contact with an electrically conductive burglar tool before the same even reaches the lock bolt. In this preferred embodiment, the rigid backer plate includes another flange projecting from the backer plate towards the striker plate slightly recessed from the hole in the striker plate opposite the first-named flange, the latch bolt hole extending between the backer plate flanges. An electrically conductive sheet having an electrical polarity opposite to the electrical polarity of the backer plate is mounted on the other backer plate flange and has respective edges close to the inner end of the other flange and to the backer plate. An electrically insulating sheet is arranged between the other backer plate flange and the electrically conductive sheet. One of the additional points consists of the other flange and the electrically conductive sheet edge close to the inner end thereof, and the other additional switch point consists of the backer plate and the electrically conductive sheet edge close thereto whereby an electrically conductive burglar tool brought into contact with a respective additional switch point causes the respective switch point to close and energize the control circuit to set off the alarm.

A burglar alarm system of the above-described structure provides a strongly reinforced doorway framing combined with a securely bolted door and an alarm that is always on without requiring setting on normal entry or departure. Normal pressure of opening, closing and locking the door will never set off the alarm but, depending on the set spacing between the contacts at the switch points, the alarm will be exceedingly sensitive to tampering with a burglar tool of any type, whether electrically conductive or not, of kicking or ramming of the door with sufficient force to displace the lock bolt towards the backer plate flange close thereto. At the same time, the entire reinforcement as well as the alarm system are concealed from view and mounted so as to make tampering therewith impossible. The alarm will be set off while the door is still locked and the burglar is outside. The entire system is inexpensive and the costs of maintenance or repair are low. It may be used with most surface-mounted locks and dead bolt locks.

BRIEF DESCRIPTION OF THE DRAWING

The above and other objects, advantages and features of the present invention will become more apparent from the following detailed description of a now preferred embodiment thereof, taken in conjunction with the accompanying drawing wherein:

FIG. 4 is a fragmentary perspective view of the striker and backer plates receiving the latch bolt;

FIG. 5 is a view similar to that of FIG. 2 and showing the terminals of the control circuit for the alarm system;

FIG. 6 is a like view diagrammatically illustrating the circuit closed by an attempted forcible entry;

FIG. 7 is a fragmentary longitudinal section showing the mounting of the backer and striker plates on the door jamb.

DETAILED DESCRIPTION OF PREFERRED EMBODIMENT

Figure 1:
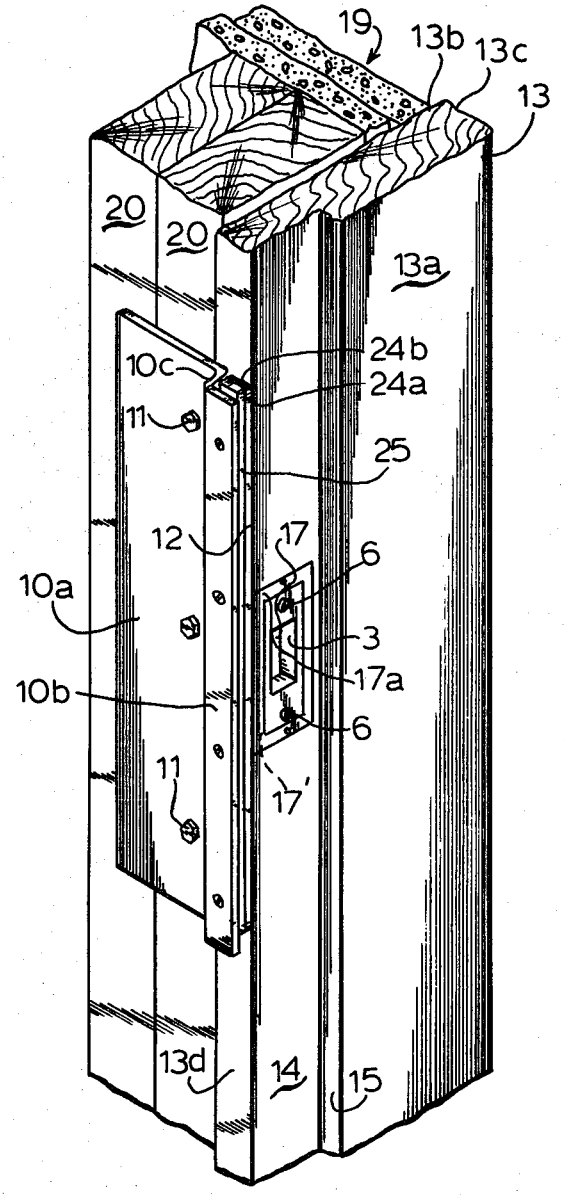
FIG. 1 is a partial perspective view of a portion of a doorway framing in the region of the door latch bolt hole, illustrating the overall structure.
Figure 2:
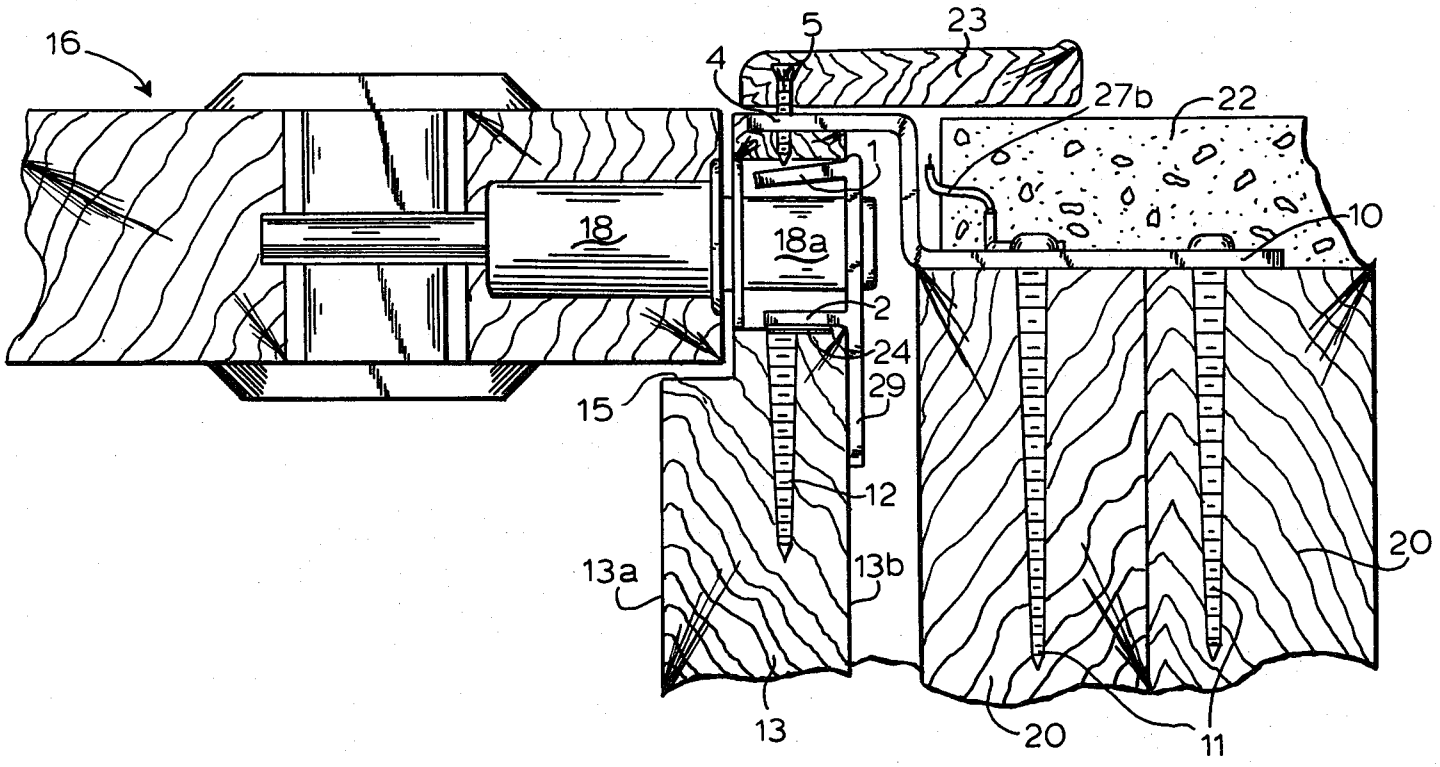
FIG. 2 is a fragmentary transverse section through the structure of FIG. 1 in the region of the door lock and door latch bolt hole in the door jamb, showing the mounting of backer plate of this invention as the essential element of a burglar alarm system, as well as a portion of the door, the lock and the latch bolt.

Referring now to the drawing and first to FIGS. 1 and 2, the doorway framing is generally conventional and comprises wooden door jamb 13 having two substantially major faces 13*a*, 13*b* and two minor faces 13*c*, 13*d* substantially perpendicular to the major faces. Major face 13*a* has a recessed end portion 14 delimited by minor face 13*d* and shoulder 15 constituting a stop for door 16. Door jamb 13 defines door latch bolt hole 17 in recessed end portion 14. Recessed into door 16 is lock 18 which has a long latch bolt 18*a* arranged to project into hole 17 for locking the door. Striker plate 17*a* with a hole aligned with hole 17 is mounted over hole 17 on the wall of recessed door jamb portion 14, all of this structure being entirely conventional, and backer plate 29 is mounted on jamb wall 13*b* with a hole in alignment with latch bolt hole 17 and the hole in the striker plate. As shown in FIGS. 2 and 4, latch bolt 18*a* is long enough to pass through the holes in the striker and backer plates in the locked position, i.e. when it is projected into hole 17.

As is generally conventional, wall 19 including wooden wall stud means constituted by two adjoining two-by-four wall framing studs 20, 20 extend adjacent major face 13*b* of door jamb 13 and the door jamb is mounted on the wall so that minor faces 13, 13*d* of door jamb 13 extend substantially parallel to the wall.

As disclosed and claimed in my U.S. Pat. No. 4,074,484, the doorway framing also comprises a strong reinforcement plate 10, preferably of steel, such as 14-gauge steel, consisting of major plate portion 10*a*, minor plate portion 10*b* and web portion 10*c* interconnecting the major and minor plate portions 10*a* and 10*b*. The major and minor plate portions define a plurality of tapped holes to receive means for securely affixing the plate to the door framing, the illustrated means being threaded fastening elements, such as bolts or screws 11 and 12 penetrating deeply into the door framing parts to which plate 10 is affixed. As shown in the drawing, minor face 13*d* of the door jamb extends in a first plane spaced from minor plate portion 10*b* and the wall studs have a face extending in a second plane inwardly recessed from the first plane. Major reinforcement plate portion 10*a* is securely affixed to the recessed face of wall studs 20, 20 by bolts 11 and minor plate portion 10*b* is securely affixed to minor face 13*d* of the door jamb by bolts 12. The wall is shown to include an exterior wall 19 and interior wall board 22 which may be, for instance, a gypsum board of plaster. Wall board 22 extends over major reinforcement plate portion 10*a* to web portion 10*c* and is flush with minor plate portion 10*b*. Furthermore, molding 23, which may be of wood, covers end portion of wall board 22 and minor plate portion 10*b* whereby the reinforcement plate is hidden from view.

As disclosed in my copending application and in my U.S. Pat. No. 4,178,588, steel backer plate 29 is arranged in the narrow space between major jamb face 13*b* and wall stud 20 in contact with major face 13*b* and in registry with striker plate 17*a*. Fasteners extend through the jamb to attach the striker and backer plates together securely to the jamb. In the preferred fastening arrangement illustrated in FIG. 7, which assures a secure and long-lasting attachment, the fasteners used to attach the striker and backer plates to door jamb 13 are Tower fasteners having Phillips heads fitting into recessed holes in striker plate 17*a* and threaded stems passing through the jamb and registering holes in backer plate 29, self-locking nuts 6*b* being affixed to the free ends of the fasteners to lock the plate assembly in position on the jamb.

Figure 3:
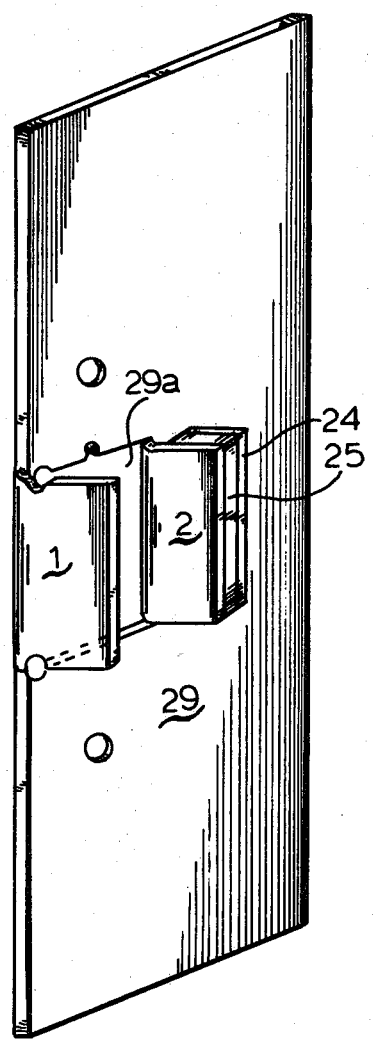
FIG. 3 is a perspective view of the backer plate.

As illustrated in FIG. 3, the backer plate of the invention differs from that of the prior art in that it defines hole 29*a* registering with latch bolt hole 17 in the door jamb for receiving a long latch bolt and two flanges 1 and 2 projecting from the backer plate at the two side walls defining backer plate hole 29*a*. Striker plate 17*a* has two side walls 3 defining the striker plate hole in registry with hole 17, one side wall 3 of the striker plate being so arranged that it guides latch bolt 18*a* when it is projected into hole 17 for locking the door. As best shown in FIGS. 2 and 4, backer plate flanges 1 and 2 extend in planes slightly recessed from the planes defined by side walls 3 of striker plate 17*a* so that, during normal use, bolt 18*a* will not touch the flanges when received in hole 17. Flange 2 projects substantially perpendicularly from the backer plate towards the striker plate while flange 1 is slightly inwardly bent towards hole 17, preferably enclosing an angle of about 85° to 87° with the backer plate.

To facilitate the insertion of the backer plate into the narrow space between stud 20 and back face 13*b* of the door jamb at the time of mounting, flange 1 and, if desired, flange 2 may be bent into or close to the plane of the striker plate and may then be extended when the striker plate is properly registered with latch bolt hole 17, at which time the backer plate flanges are bent to project into hole 17 to assume the illustrated positions.

As is shown in FIG. 1 at 17', the door jamb has a weak point caused by the provision of door latch hole 17 in the jamb and which could easily split or break if the door were kicked in but which is protected against such force by reinforcement plate 10 extending perpendicularly thereto about six inches above and six inches below the center of the door latch hole. This weak point is the location where burglars are likely to insert a burglar tool, such as a crowbar or a screw driver, in an attempt to jimmy the door open. Such burglar tools have an elongated metal shaft which is electrically conductive although non-conductive instruments may sometimes be used.

As will not be explained in connection with FIGS. 5, 6 and 8, the present invention provides an improved burglar alarm system which will be set off in the event of such a jimmying attempt under almost any conceivable circumstances and before major damage has been done to the door or the jamb. Due to the provision of a plurality of circuit closing switch points around latch bolt 18*a*, the alarm system is exceedingly sensitive to all kinds of jimmying attempts and at a very early stage of such an attempt while, at the same time, being secure and insensitive to being set off unintentionally during the normal course of opening and locking the door. Furthermore, the alarm system need not be switched on and off but is always responsive to forcible entry.

According to the invention, an exceedingly sensitive switch point 19 for the burglar alarm system is provided by backer plate flange 1 in cooperation with set screw 5 mounted in reinforcement plate 10 and having a contact point normally slightly spaced from, and facing, flange 1. Electrically conductive backer plate 29 is of one polarity, for instance, negative, while electrically conductive screw 5 is of the opposite polarity, i.e. positive. As shown in FIG. 5, backer plate flange 1 projecting from the backer plate at an angle of about 85° to 87° is spaced from latch bolt 18*a* of the locked door a distance of about ⅛" or sufficiently to assure clearance between the flange and the bolt. Similarly, screw 5 is set so that there is a safe clearance between its point and flange 1, i.e. also about ⅛", this clearance being adjustable to any desired sensitivity by turning the screw. Set screw 5 may be of brass or any other suitable material of high electric conductivity and may be one half threaded and one half tap screw. It is inserted through tapped hole 4 in minor portion 10*b* of reinforcement plate 10. If, as shown in FIG. 5, steel plates 10 and 29 are of the same polarity, insulating jacket 6 surrounds screw 5 to insulate it electrically from plate 10 since the screw is of the opposite polarity. If, as shown in FIG. 6, plate 10 is of a polarity opposite to that of plate 29, the screw may be fastened in the steel plate directly.

Figure 8:
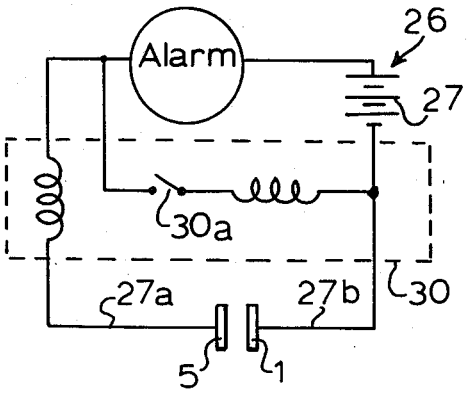
FIG. 8 illustrates a burglar alarm control circuit.

As shown in FIG. 8, which illustrates a conventional burglar alarm circuit merely by way of example, any such circuit being useful in combination with the invention, electric control circuit 26 is connected to a burglar alarm and is energizable to set off the alarm, the circuit being connected by lead wires 27*a*, 27*b* to backer plate 29 and reinforcement plate 10 (or screw 5).

In the preferred illustrated embodiment and as an extra safe-guard making the alarm system more versatile, electrically conductive sheet 24 is arranged on backer plate flange 2 to form additional switch points 20 and 21 for the alarm circuit. Copper being a readily available excellent electrical conductor, it is preferred for sheet 24 but any suitable electrically conductive sheet material may be used for this purpose. Insulating sheet 25 of any suitable synthetic resin material or any other insulating material normally used in electrical insulation is interposed between backer plate flange 2 and electrically conductive sheet 24 since the latter is of a polarity opposite to that of the backer plate, for instance positive. Sheet 24 is connected to control circuit 26 in parallel to screw 5 to provide alternative switch points for energizing the circuit. For illustrative purposes, the thickness of sheets 24 and 25 has been exaggerated in the drawing.

FIG. 5 schematically illustrates three possible ways of setting off the alarm by forcing crowbar 28 or a like metal burglar tool in the usual manner between door 16 and door jamb 13 to gain forcible entry through the locked door. As shown in full lines, when burglar tool 28 is forced between the door and the jamb in front of latch bolt 18*a* and before it even touches the bolt, i.e. before major damage has been done to the structure, it may slide along electrically conductive sheet 24 of one polarity until it touches backer plate 29 of the opposite polarity. Since the burglar tool is electrically conductive itself, sheet 24 and plate 29 of opposite polarity will make contact at switch point 21 and actuate the burglar alarm. Alternatively and as shown in broken lines, burglar tool 28*a* may slide along the side of conductive sheet 24 past insulating sheet 25 until it contacts flange 2 of the backer plate, again closing the control circuit and setting off the alarm at switch point 20. If burglar tool 28*b*, shown in dark shading, is forced directly against latch bolt 18*a*, it will press the latch bolt back and dislodge it sufficiently from its straight position to contact and bend back backer plate flange 1 until the latter makes contact at switch point 19 with screw 5 (see FIG. 6). It will be noted that the burglar alarm is actuated in this case even if the burglar tool is not of metal, i.e. electrically conductive. In other words, the alarm will be sounded under the most versatile break-in attempts and before substantial damage has been done to the structure, requiring a minimum of repairs afterwards. Also, after the door is opened, i.e. the bolt has been retracted, flange 1 will normally snap back into its slightly inwardly projecting position. If not, it may be readily bent into this position for subsequent use. As shown by the circuit in FIG. 6, by splicing lead wires from the bell wire to plate 29 and providing another lead wire to plate 10, contact 1–5 may act as a door bell button.

The burglar alarm control circuit 26 schematically illustrated in FIG. 8 includes battery 27 as an electrical power source and relay 30 with a normally open contact 30*a*, the first switch point for energizing the circuit being illustrated at 1 and 5. The additional switch points 24, 2 and 24, 29 may be connected in parallel so that, when an electrically conductive burglar tool 28 or 28*a* makes electrical contact between sheet 24 and either the backer plate or its flange 2 or burglar tool 28*b* pushes latch bolt 18*a* against flange 1 and presses the latter into contact with screw 5, circuit 26 is energized and contact 30*a* is closed. This contact remains closed even after the tool is withdrawn and until it is reset, i.e. manually opened, so that the burglar alarm keeps sounding.

What is claimed is:

1. A burglar alarm system mounted in a reinforced doorway framing which comprises a wooden door jamb having two substantially parallel major faces and two minor faces substantially perpendicular to the major faces, one of the major faces having a recessed end portion delimited by one of the minor faces and a shoulder constituting a stop for a door, and the door jamb defining a door latch bolt hole in the recessed end portion, a wall including wooden wall stud means adjacent the other major face of the door jamb, the other major face and the wall defining a narrow space therebetween, the door jamb being mounted on the wall and the minor faces of the door jamb extending substantially parallel to the wall, a reinforcement metal plate extending over a substantial portion of the wall stud means and a substantial portion of the one minor face of the door jamb, the reinforcement plate being securely affixed to the wall stud means and the one minor face of the door jamb and covering a substantial region of the minor door jamb face adjacent and beyond the door latch bolt hole, the securely affixed plate holding the door jamb firmly in position, a striker plate defining a hole registering with the bolt hole and mounted thereover on the jamb, an electrically conductive rigid backer plate arranged in the narrow space in contact with the other major face of the door jamb and in registry with the striker plate, the backer plate having a predetermined electrical polarity and defining a hole registering with the hole in the striker plate, whereby a long latch bolt may be projected from the door into the latch bolt hole through the holes in the striker and backer plates, and fastening elements securing the striker and backer plates to the door jamb, the fastening elements passing through the jamb between the striker and backer plates whereby the door jamb is sandwiched between the striker and backer plates, and the burglar alarm system comprising a burglar alarm and an electrical control circuit connected to the burglar alarm and energizable to set off the alarm, the circuit having a normally open switch point consisting of a flange projecting from the backer plate towards the striker plate slightly recessed from the hole in the striker plate and slightly inclined towards the striker plate hole whereby the backer plate flange is out of contact with, but close to, the long latch bolt projected into the latch bolt hole for locking the door, and a contact element having an electrical polarity opposite to the electrical polarity of the backer plate, the contact element being mounted in the reinforcement plate and extending towards, but being normally slight spaced from, the flange whereby the switch point is open and the control circuit is not energized, displacement of the projected latch bolt towards the flange by a burglar tool and resultant displacement of the flange towards the contact element causing the flange to touch the contact element and energize the control circuit to set off the alarm.

2. The burglar alarm system of claim 1, wherein the rigid backer plate defines two holes and the fastening elements are two Tower fasteners having Phillips screw heads and threaded ends received in the tapped holes, and further comprising self-locking nuts secured over the threaded ends.

3. The burglar alarm system of claim 1 or 2, wherein the backer plate is a steel plate having a length in the range of six inches and a width in the range of two inches.

4. The burglar alarm system of claim 1, wherein the backer plate flange is recessed from the striker plate hole an average of about one eighth of an inch, the contact element is normally spaced from the flange about one eighth of an inch and the backer plate flange is inclined at an angle of about 85° to 87°.

5. The burglar alarm system of claim 1 or 4, wherein the contact element is a screw threadedly received in the reinforcement plate and having a point extending towards the backer plate flange.

6. The burglar alarm system of claim 5, wherein the screw is a brass set screw enabling the space between the contact element and the flange to be adjusted.

7. The burglar alarm system of claim 1 or 4, wherein the electrical control circuit has two additional normally open switch points, the rigid backer plate including another flange projecting from the backer plate towards the striker plate slightly recessed from the hole in the striker plate opposite the first-named flange, the latch bolt hole extending between the backer plate flanges, an electrically conductive sheet having an electrical polarity opposite to the electrical polarity of the backer plate, the electrically conductive sheet being mounted on the other backer plate flange and having respective edges close to the inner end of the other flange and to the backer plate, and an electrically insulating sheet arranged between the other backer plate flange and the electrically conductive sheet, one of the additional switch points consisting of the other flange and the electrically conductive sheet edge close to the inner end thereof, and the other additional switch point consisting of the backer plate and the electrically conductive sheet edge close thereto whereby an electrically conductive burglar tool brought into contact with a respective one of the additional switch points causes the respective switch point to close and energize the control circuit to set off the alarm.

* * * * *